US009999286B2

(12) United States Patent
Wu

(10) Patent No.: US 9,999,286 B2
(45) Date of Patent: Jun. 19, 2018

(54) SEALABLE POWDER BOX

(71) Applicant: SHENZHEN BEAUTY STAR CO., LTD, Shenzhen, Guangdong (CN)

(72) Inventor: Shaoyong Wu, Guangdong (CN)

(73) Assignee: SHENZHEN BEAUTY STAR CO., LTD, Shenzhen (CN)

( * ) Notice: Subject to any disclaimer, the term of this patent is extended or adjusted under 35 U.S.C. 154(b) by 185 days.

(21) Appl. No.: 14/979,612

(22) Filed: Dec. 28, 2015

(65) Prior Publication Data

US 2016/0128444 A1 May 12, 2016

Related U.S. Application Data

(63) Continuation of application No. PCT/CN2014/073833, filed on Mar. 21, 2014.

(30) Foreign Application Priority Data

Jun. 27, 2013 (CN) ..... 2013 2 0374212 U

(51) Int. Cl.

| | |
|---|---|
| ***A45D 33/00*** | (2006.01) |
| ***B65D 43/14*** | (2006.01) |
| ***B65D 53/02*** | (2006.01) |
| ***B65D 43/16*** | (2006.01) |
| ***B65D 45/30*** | (2006.01) |

(52) U.S. Cl.

CPC ..... *A45D 33/006* (2013.01); *B65D 43/14* (2013.01); *B65D 43/167* (2013.01); *B65D 45/305* (2013.01); *B65D 53/02* (2013.01); *A45D 2200/051* (2013.01); *B65D 2543/00972* (2013.01)

(58) Field of Classification Search

CPC .... A45D 33/003; A45D 33/006; A45D 33/16; A45D 2200/051; A45D 2200/052; B65D 43/14; B65D 43/167; B65D 45/305; B65D 2543/00972

See application file for complete search history.

(56) References Cited

U.S. PATENT DOCUMENTS

| | | | | |
|---|---|---|---|---|
| 9,220,332 | B1 * | 12/2015 | DeVito | A45D 33/006 |
| 2001/0022185 | A1 * | 9/2001 | Yuhara | A45C 13/008 132/296 |
| 2009/0188518 | A1 * | 7/2009 | Thorpe | A45D 33/003 132/307 |
| 2014/0283870 | A1 * | 9/2014 | Byeon | A45D 33/006 132/315 |

* cited by examiner

*Primary Examiner* — Rachel Steitz

(57) ABSTRACT

A sealable powder box of the present application comprises an upper casing, a lower casing, an inner casing mounted in the upper casing, a storage box mounted in the lower casing, and a tray arranged in the storage box. The sealable powder box further comprises a gasket, the gasket is arranged in the tray by means of injection molding, or is sandwiched between the tray and the storage box and engaged with the tray. The inner casing is mounted in the upper casing, and the top part of the inner casing penetrates the top part of the upper casing. The upper casing and the inner casing are axially slidable and radially rotatable relative to each other, the storage box is engaged in the lower casing and threadingly connected with the upper casing, and the inner casing and the tray are rotatably connected with the lower casing by a pin.

12 Claims, 8 Drawing Sheets

SEALABLE POWDER BOX

CROSS-REFERENCE TO RELATED APPLICATIONS

This present application is a Continuation Application of PCT application No. PCT/CN2014/073833 filed on Mar. 21, 2014, which claims the benefit of Chinese Patent Application No. 201320374212.7 filed on Jun. 27, 2013, the contents of which are hereby incorporated by reference.

FIELD OF THE INVENTION

The present application relates to the technical field of cosmetics packaging, and more particularly to a sealable powder box.

BACKGROUND OF THE INVENTION

Nowadays, various powder boxes develop in the cosmetics product market widely, and have already been necessary consumer goods in many female friends' life. With the continuous increase of the market requirement, many kinds of durable, elegant, and easily operable outer packages emerge in endlessly, and their social status are improved by high quality package materials and packing methods. However, existing powder boxes generally have no sealing function, and thus the content in these powder boxes are prone to be oxidized.

SUMMARY OF THE INVENTION

The technical problem to be solved by the present invention is to provide a sealable powder box, which enables a lid and a powder box body to realize good seal easily on the premise of simple opening and closing ways.

In order to solve the above technical problem, the present application provides a sealable powder box, which comprises an upper casing, a lower casing, an inner casing mounted in the upper casing, a storage box mounted in the lower casing, and a tray arranged in the storage box. The sealable powder box further comprises a gasket, the gasket is arranged in the tray by means of injection molding, or is sandwiched between the tray and the storage box and engaged with the tray. The inner casing is mounted in the upper casing, and the top part of the inner casing penetrates the top part of the upper casing to be exposed. The upper casing and the inner casing are axially slidable and radially rotatable relative to each other in the predetermined ranges, the storage box is engaged in the lower casing and threadingly connected with the upper casing, and the inner casing and the tray are rotatably connected with the lower casing by a pin.

Furthermore, the tray forms a gasket clasp downwards at its bottom wall, and the portion of the bottom wall of the tray located at the outside of the gasket clasp is provided with a gasket pressing surface; the inside of the storage box is provided with a step-shaped gasket fastening surface, the bottom of the gasket clasp is engaged with the bottom of the gasket, so that the gasket is engaged with the tray; the upper edge of gasket abuts the gasket pressing surface, and the lower edge of the gasket abuts the gasket fastening surface.

Furthermore, the upper casing includes a first top wall and a double-layered first sidewall extending from the first top wall and forming a loop, the first top wall is provided with a through hole and is inwardly provided around the through hole with an annular pressing wall being coaxial with the through hole; the inner casing includes an annular double-layered second sidewall, a second top wall connected with the top edge of the inner layer of the second sidewall, and a connecting wall connected with both bottom edges of inner and outer layers of the second sidewall; a top surface of the connecting wall is matched with a bottom end of the pressing wall to limit upward sliding of the inner casing relative to the upper casing.

Furthermore, the bottom surface of the connecting wall extends vertically and downwards to form a lens mounting loop, and the sealable powder box further comprises a lens forming an interference fit with the lens mounting loop and thereby mounted in the inner casing.

Furthermore, the part of the bottom surface of the connecting wall located at an outside of the lens mounting loop is provided with a lower pressing surface, when the sealable powder box is closed, the lower pressing surface is matched with and pressed against the top edge of the tray and the top edge of the storage box.

Furthermore, an inside of the pressing wall is inwardly and spacedly provided with a limiting buckle and a positioning groove; the outer edge of the top wall of the inner casing extends radially and outwards to form a flange, the bottom surface of the flange is matched with the top surface of the limiting buckle to prevent the upper casing from separating from the inner casing and limit upward sliding of the upper casing relative to the inner casing; the inner layer of the second sidewall of the inner casing is provided with the positioning rib protruding outwards and the limiting groove recessing inwards, the positioning rib is forced into the positioning groove at the inside of the pressing wall correspondingly, so that the upper casing is radially held relative to the inner casing; the limiting groove is matched with the limiting buckle to limit a distance of a rotation of the upper casing relative to the inner casing.

Furthermore, the inmost upper part of the double-layered first sidewall of the upper casing is provided with the rotation matching surface; the outer layer of the second sidewall of the inner casing is provided with a rotation matching rib protruding outwards, and the rotation matching rib is matched with the rotation matching surface of the upper casing to facilitate a rotation of the upper casing relative to the inner casing.

Furthermore, the upper casing is provided with a first two-headed thread at a the lower part of the rotation matching surface, the storage box is provided with a second two-headed thread at the upper part of the outside thereof, and the upper casing is rotatably connected with the storage box by the first and second two-headed threads.

Furthermore, the outer layer of the second sidewall of the inner casing forms a downward cantilever with a pin hole, the sidewall of the tray is provided with an outward cantilever with a pin hole, and the upper part of the storage box is provided with a gap configured to allow the cantilever of the inner casing and the cantilever of the tray to pass through; the lower casing includes a bottom wall and a plurality of sidewalls, one of the sidewalls is provided with a gap configured to mount the cantilever of the inner casing and the cantilever of the tray, the sidewall is further provided with pin holes arranged at parts thereof located at two sides of the gap of the sidewall, and a pin is inserted in the pin holes of the inner casing, the tray, and the lower casing.

Furthermore, the lower part of an outside of the storage box is provided with at least one buckle, another sidewall of the lower casing that is opposite to the sidewall of the lower casing being provided with the gap is provided with at least one buckling groove, the buckling groove is matched with the buckle of the storage box to engage the storage box with the lower casing.

Compared with the current technology, in the sealable powder box provided by the present application, the upper casing and the inner casing can axially slide and radially rotate relative to each other in predetermined ranges, the upper casing is connected with the storage box by thread, and the gasket is arranged between the tray and the storage box. Therefore, by adopting the technical solution of the present application, perfectly seal between a lid and a powder box body can be easily realized under the condition of ensuring that the powder box is opened and closed by simple methods.

DETAILED DESCRIPTION OF THE PREFERRED EMBODIMENT

Figure 1:
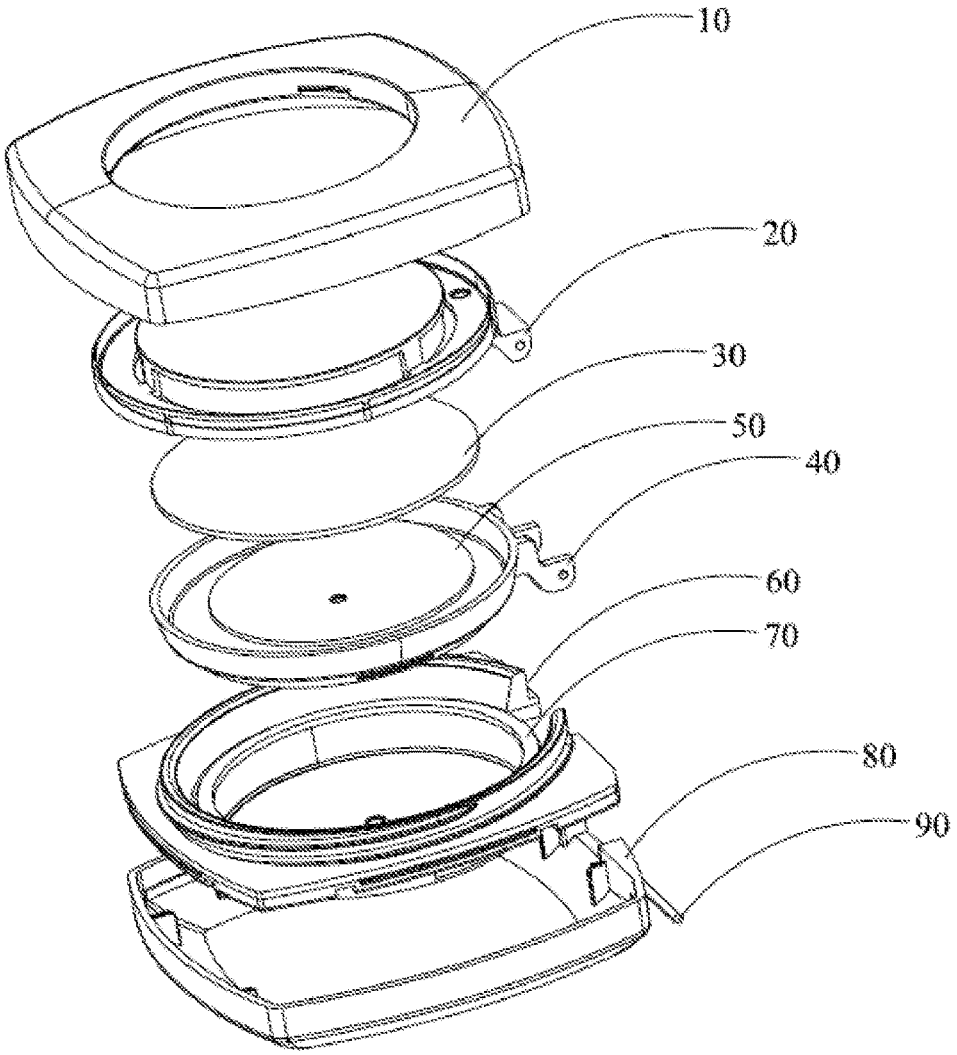
FIG. 1 is a perspective exploded view of a sealable powder box provided by an embodiment of the present application.

In order to make the technical problems to be solved by the present application, the technical solutions of the present application, and the advantages of the present application be clear, the present application will be further described with reference to the accompany drawings and embodiments. It should be understood that the embodiments described herein are only intended to illustrate but not to limit the present application.

Referring to FIGS. 1-5, a sealable powder box provided by an embodiment of the present application includes an upper casing 10, an inner casing 20, a lens 30, a tray 40, a powder puff 50, a storage box 60, a gasket 70, a lower casing 80, and a pin 90. The inner casing 20 is mounted in the upper casing 10, and the top part of the inner casing 20 penetrates the top part of the upper casing 10 to be exposed. The upper casing 10 and the inner casing 20 are axially slidable and radially rotatable relative to each other in predetermined ranges. The lens 30 is arranged in the inner casing 20. The storage box 60 is engaged in the lower casing 80 and threadingly connected with the upper casing 10. The powder puff 50 is arranged in the tray 40, the tray 40 is arranged in the storage box 60. The gasket 70 is annular, and is sandwiched between the tray 40 and the storage box 60 and engaged with the tray 40. In another embodiment, the gasket 70 can also be formed in the tray 40 by means of injection molding such as two-shot molding. The inner casing 20 and the tray 40 are rotatably connected with the lower casing 80 by the pin 90.

Figure 6:
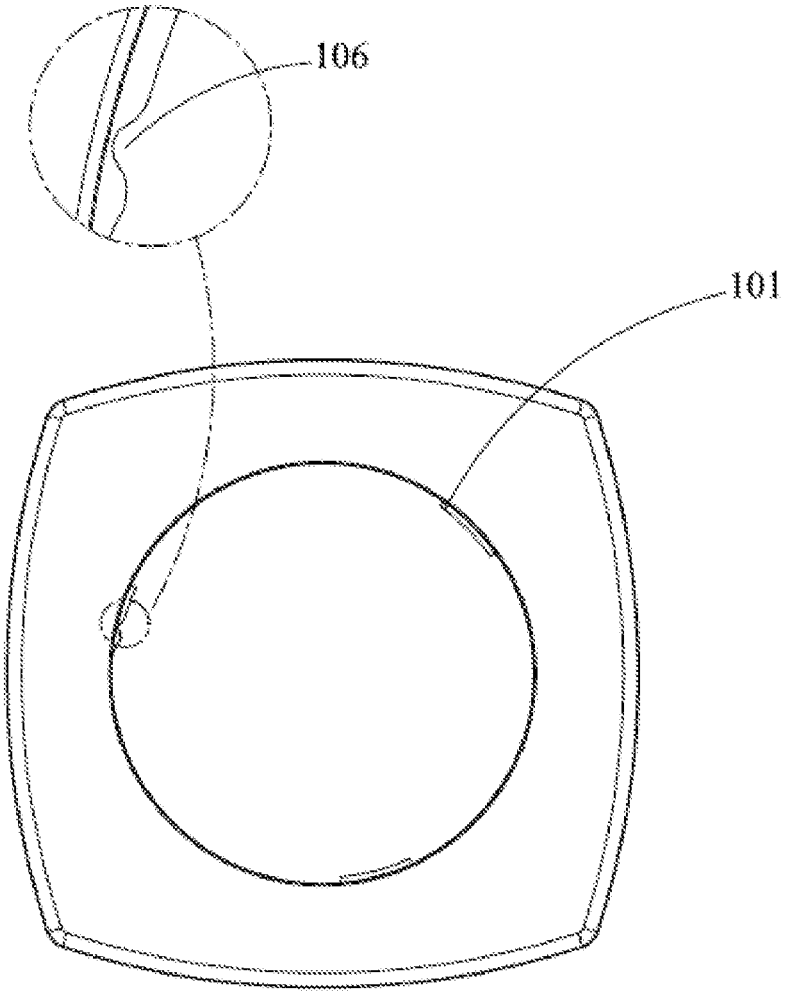
FIG. 6 is a perspective schematic view of an upper casing of the sealable powder box shown in FIG. 1.
Figure 7:
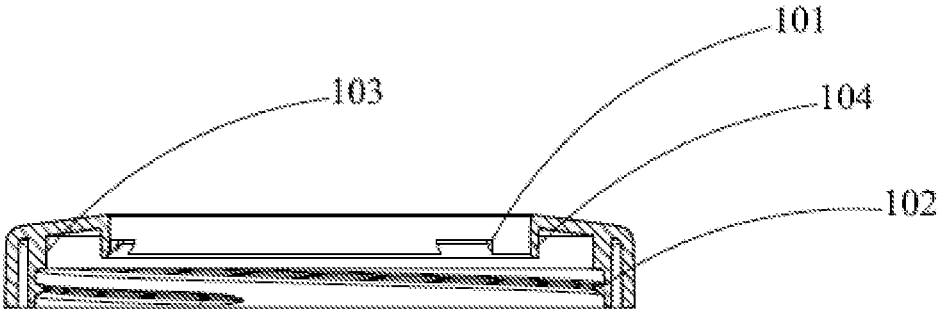
FIG. 7 is a cut-away view of the upper casing shown in FIG. 6.
Figure 8:
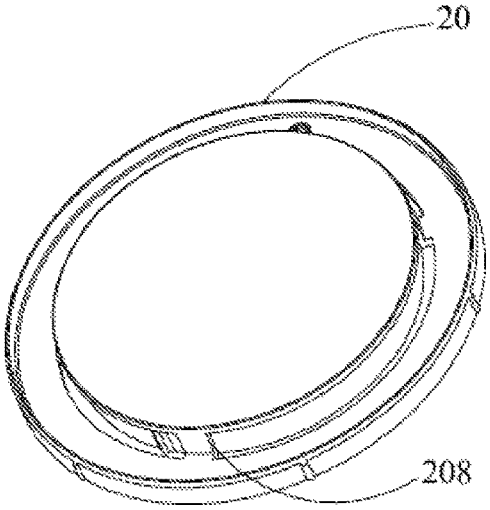
FIG. 8 is a perspective schematic view of an inner casing of the sealable powder box shown in FIG. 1.
Figure 9:
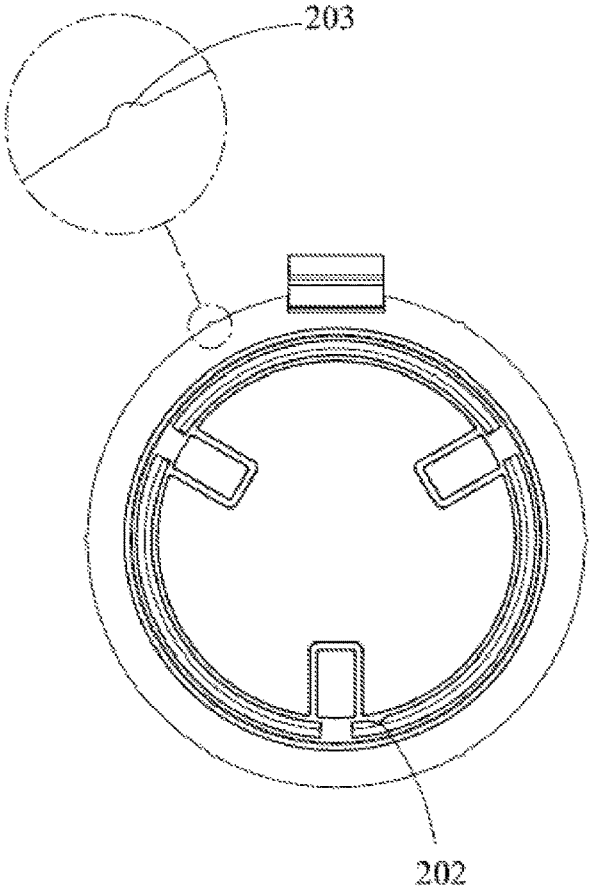
FIG. 9 is another perspective schematic view of the inner casing shown in FIG. 8, viewed from another angle.
Figure 10:
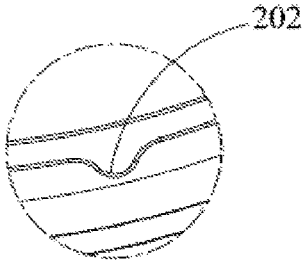
FIG. 10 is a partially enlarged view of FIG. 9.
Figure 11:
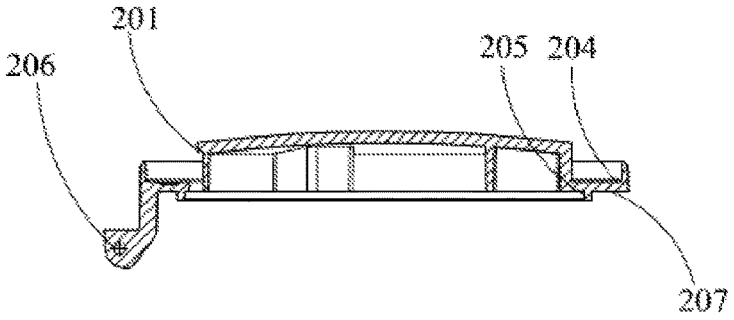
FIG. 11 is a cut-away view of the inner casing shown in FIG. 8.
Figure 12:
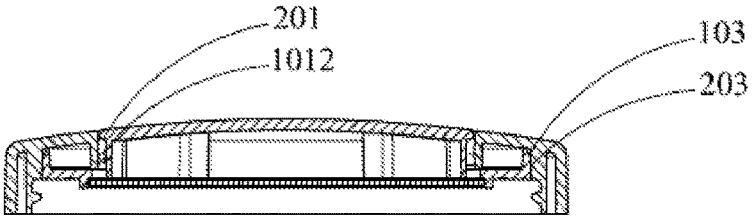
FIG. 12 is a cut-away view of a sub-assembly including the upper casing and the inner casing shown in FIG. 1.
Figure 13:
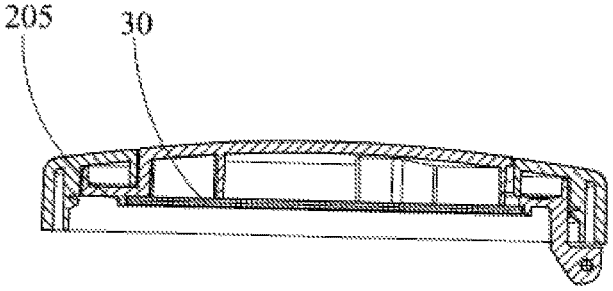
FIG. 13 is a cut-away view of a sub-assembly including the inner casing and a lens shown in FIG. 1.

Referring to FIG. 6 and FIG. 7, the upper casing 10 includes a first top wall and a double-layered first sidewall extending from the first top wall and forming a loop, wherein, the first top wall is provided with a through hole and is inwardly provided around the through hole with an annular pressing wall 104 that is coaxial with the through hole; an inside of the pressing wall 104 is inwardly and spacedly provided with a limiting buckle 101 and a positioning groove 106. The inmost upper part of the double-layered first sidewall is provided with a rotation matching surface 103, and the lower part of the rotation matching surface 103 is provided with a first two-headed thread 102.

Referring to FIGS. 8-13, the inner casing 20 includes an annular and double-layered second sidewall, a second top wall connected with the top edge of the inner layer of the second sidewall, and a connecting wall 204 connected with both bottom edges of inner and outer layers of the second sidewall. Wherein, an outer edge of the top wall of the inner casing 20 extends radially and outwards to form a flange 201, and a bottom surface of the flange 201 is matched with the top surface of the limiting buckle 101 to prevent the upper casing 10 from separating from the inner casing 20 and limit upward sliding of the upper casing 10 relative to the inner casing 20. The inner layer of the second sidewall of the inner casing 20 is provided with a positioning rib 202 protruding outwards and a limiting groove 208 recessing inwards, the positioning rib 202 is forced into the positioning groove 106 at the inside of the pressing wall 104 correspondingly, so that the upper casing 10 is radially held relative to the inner casing 20; the limiting groove 208 is matched with the limiting buckle 101 to limit a distance of a rotation of the upper casing 10 relative to the inner casing 20. The outer layer of the second sidewall of the inner casing 20 is provided with a rotation matching rib 203 protruding outward. A top surface of the connecting wall 204 is matched with a bottom end of the pressing wall 104 to limit upward sliding of the inner casing 20 relative to the upper casing 10. The bottom surface of the connecting wall 204 extends vertically and downwards to form a lens mounting loop 205, and the lens mounting loop 205 forms an interference fit with the lens 30 to mount the lens 30 in the inner casing 20. A part of the bottom surface of the connecting wall 204 located at an outside of the lens mounting loop 205 is provided with a lower pressing surface 207, when the sealable powder box is closed, the lower pressing surface 207 is matched with and pressed against the top edge of the tray 40 and the top edge of the storage box 60. The outer layer of the second sidewall of the inner casing 20 forms a downward cantilever, and the cantilever is provided with a pin hole 206.

Figure 14:
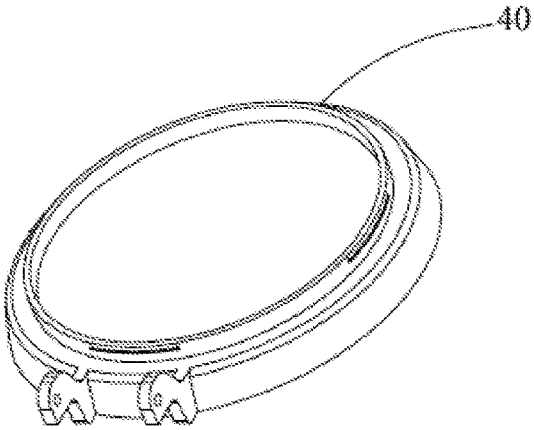
FIG. 14 is a perspective schematic view of a tray of the sealable powder box shown in FIG. 1.
Figure 15:
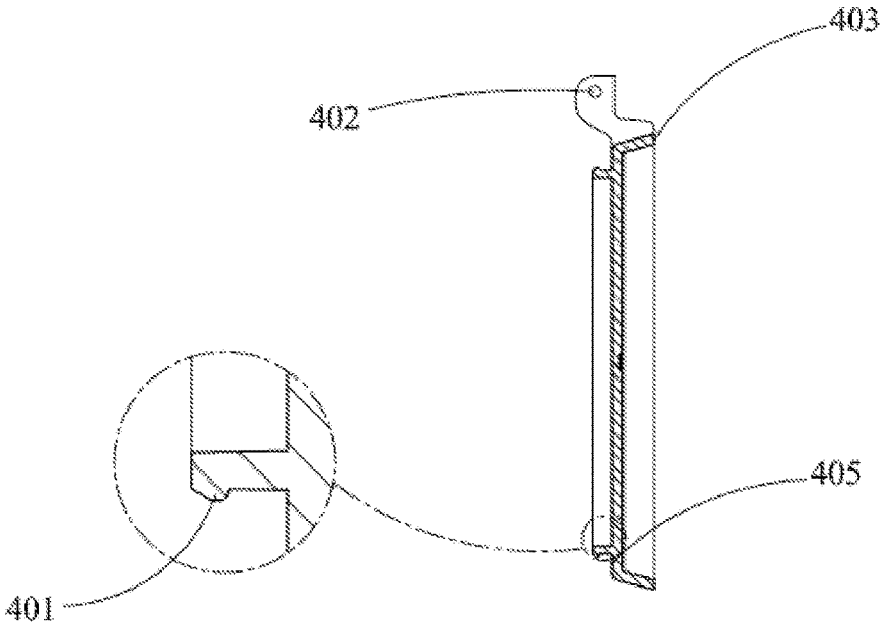
FIG. 15 is a cut-away view of the tray shown in FIG. 14.
Figure 16:
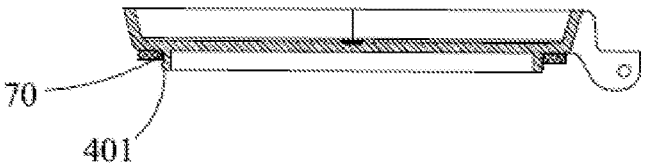
FIG. 16 is a cut-away view of a sub-assembly including the tray and a gasket shown in FIG. 1.

Referring to FIGS. 14-16, the tray 40 is disk-shaped, the bottom wall of the tray 40 forms a gasket clasp 401 downwards, the sidewall of the tray 40 is provided with an outward cantilever, and the cantilever is provided with a pin hole 402. The portion of the bottom wall of the tray 40 located at the outside of the gasket clasp 401 is provided with a gasket pressing surface 405. The gasket pressing surface 405 abuts the upper edge of gasket 70, the bottom of the gasket clasp 401 is engaged with the bottom of the gasket 70, so that the gasket 70 is engaged with the tray 40.

Figure 17:
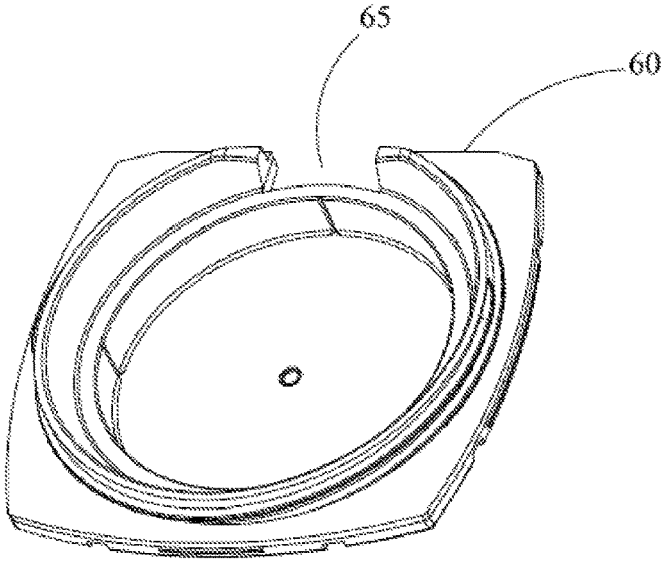
FIG. 17 is a perspective schematic view of a storage box of the sealable powder box shown in FIG. 1.
Figure 18:
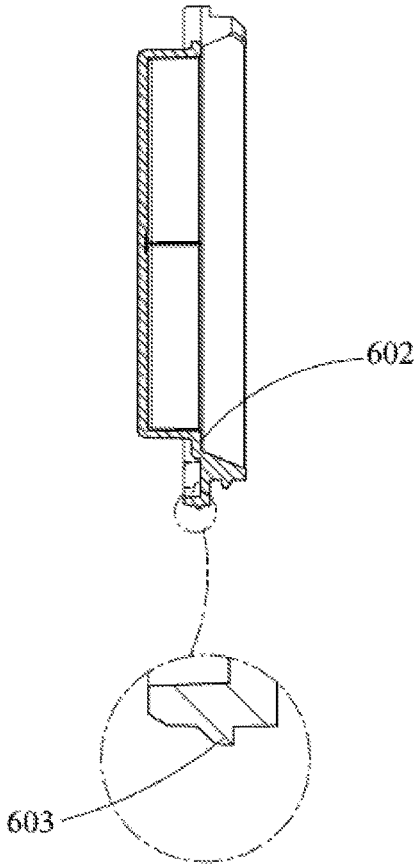
FIG. 18 is a cut-away view of the storage box shown in FIG. 17.
Figure 19:
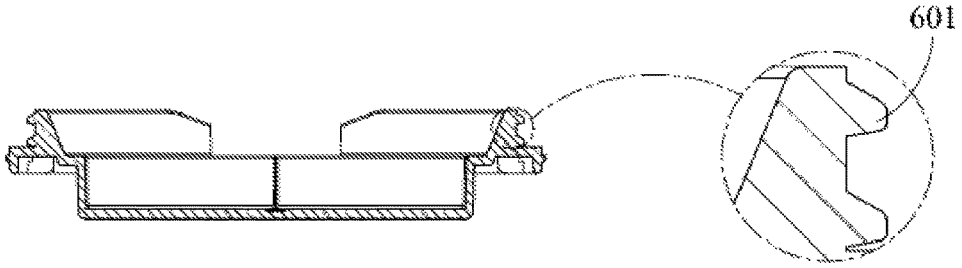
FIG. 19 is another cut-away view of the storage box shown in FIG. 17.

Referring to FIGS. 17-19, the upper part of the outside of the storage box 60 is provided with a second two-headed thread 601, and the lower part of the outside of the storage box 60 is provided with at least one buckle 603; the inside of the storage box 60 is provided with a step-shaped gasket fastening surface 602 configured to abut the lower edge of the gasket 70. The upper part of the storage box 60 is provided with a gap 65 configured to allow the cantilever of the inner casing 20 and the cantilever of the tray 40 to pass through.

Figure 20:
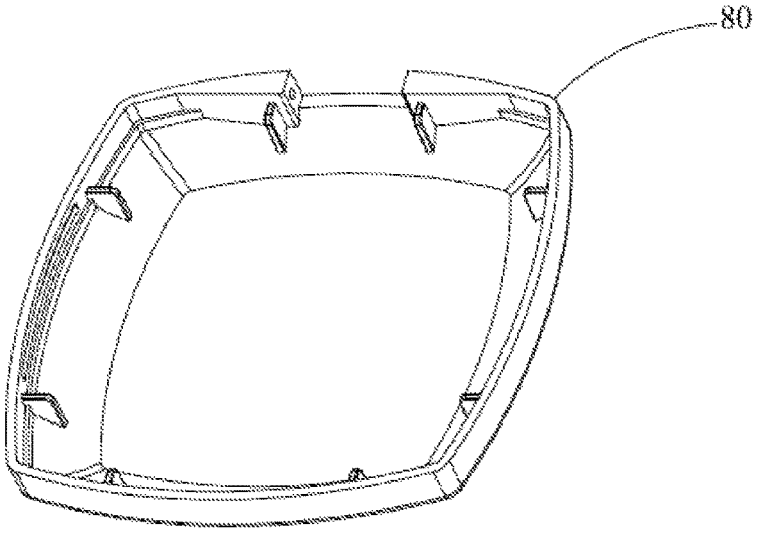
FIG. 20 is a perspective schematic view of a lower casing of the sealable powder box shown in FIG. 1.
Figure 21:
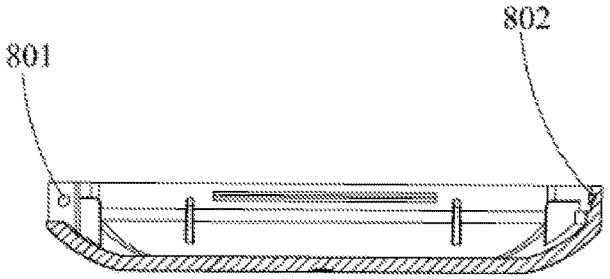
FIG. 21 is a cut-away view of the lower casing shown in FIG. 20.
Figure 22:
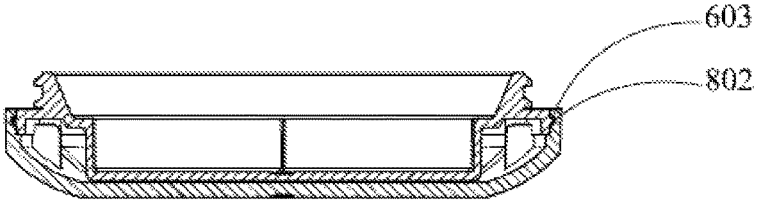
FIG. 22 is a cut-away view of a sub-assembly including the storage box and the lower casing shown in FIG. 1.

Referring to FIGS. 20-22, the lower casing 80 includes a bottom wall and a plurality of sidewalls, one of the sidewalls is provided with a plurality of gaps configured to mount the cantilever of the inner casing 20 and the cantilever of the tray 40, the sidewall of the lower casing 80 is further provided with pin holes 801 arranged at parts thereof located at two sides of the gap of the sidewall, and the pin 90 is inserted in the above-mentioned pin holes 801, 402, 206. Another sidewall of the lower casing 80 that is opposite to the sidewall of the lower casing 80 being provided with the gap is provided with at least one buckling groove 802, the buckling groove 802 is matched with the buckle 603 of the storage box 60.

In assembly, by the cooperation between the positioning rib 202 and the positioning groove 106, the upper casing 10 and the inner casing 20 can be radially positioned; under the mutual cooperation between the rotation matching surface 103 and the rotation matching rib 203, the upper casing 10 and the inner casing 20 can be rotated relative to each other smoothly, until the flange 201 of the inner casing 20 slides through the limiting buckle 101 and is assembled together with the limiting buckle 101. Subsequently, the lens 30 is made to form an interference fit with the lens mounting loop 205 of the inner casing 20, so that the lens 30 is mounted into the inner casing 20. Afterwards, the gasket 70 is assembled together with the tray 40 via the gasket clasp 401, and the buckle 603 of the storage box 60 is forced into the buckle groove 802 of the lower casing 80, so that the storage box 60 is engaged with the lower casing 80. Finally, the pin 90 is inserted through the pin hole 206 of the inner casing 20, the pin hole 402 of the tray 40, and the pin hole 801 of the lower casing 80, and thus a sub-assembly including the upper casing 10, the inner casing 20, and the lens 30, a sub-assembly including the tray 40 and the gasket 70, and a sub-assembly including the storage box 60 and the lower casing 80 are completely assembled together to form a sealable powder box.

Figure 2:
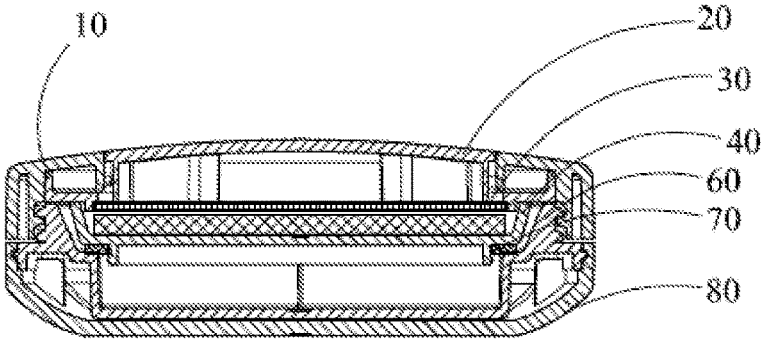
FIG. 2 is a first cut-away view of the sealable powder box shown in FIG. 1.
Figure 3:
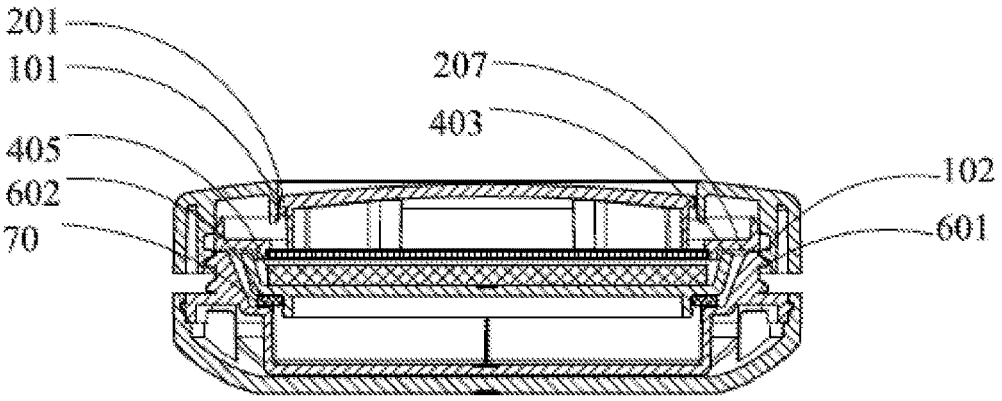
FIG. 3 is a second cut-away view of the sealable powder box shown in FIG. 1.
Figure 4:
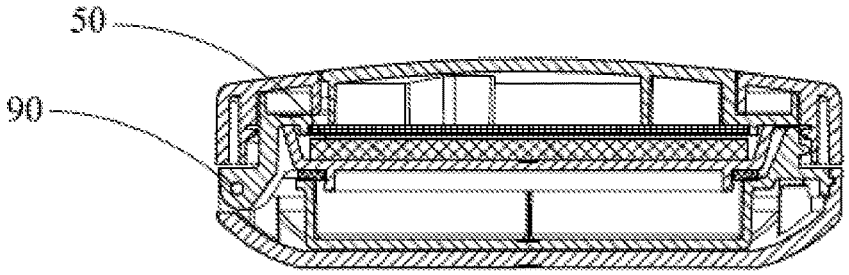
FIG. 4 is a third cut-away view of the sealable powder box shown in FIG. 1.
Figure 5:
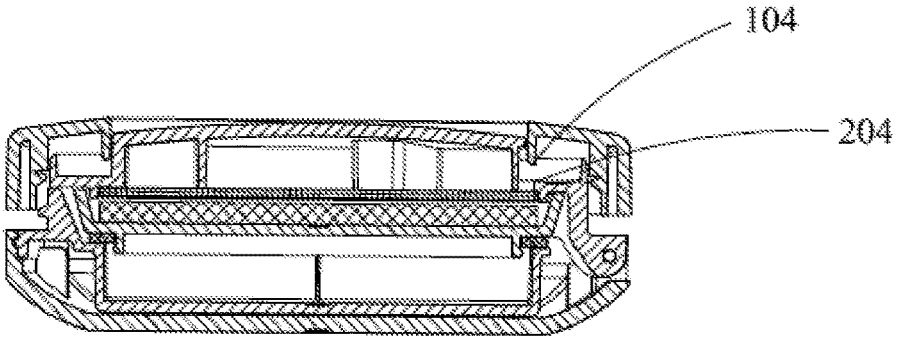
FIG. 5 is a fourth cut-away view of the sealable powder box shown in FIG. 1.

Furthermore, by the cooperation between the first two-headed thread 102 of the upper casing 10 and the second two-headed thread 601 of the storage box 60, the upper casing 10 is rotatable relative to the storage box 60, so that a distance between the upper casing 10 and the tray 40 is changed, and a gap between the inner casing 20 and the tray 40 is adjusted thereby. In particular, as shown in FIG. 2, when the upper casing 10 is rotated towards the storage box 60, the pressing wall 104 of the upper casing 10 will press the connecting wall 204 of the inner casing 20 downwards, thus the inner casing 20 is driven to approach the tray 40 and the lower pressing surface 207 of the inner casing 20 finally abuts the top edge of the tray 40, thereby achieving the purpose of sealing the tray 40. As shown in FIG. 3, when the upper casing 10 is unscrewed from the storage box 60, the pressing wall 104 of the upper casing 10 is released, gradually leaves the connecting wall 204 of the inner casing 20, and drives the inner casing 20 to move upwards. Thus, the lower pressing surface 207 of the inner casing 20 separates from the top edge of the tray 40, until the limiting buckle 101 of the upper casing 10 abuts the flange 201 of the inner casing 20.

The sealable powder box provided by the embodiment of the present application can be opened by the following method: when the powder box needs to be opened, the upper casing 10 is rotated, so that the first two-headed thread 102 of the upper casing 10 generates a force on the second two-headed thread 601 of the storage box 60, and the upper casing 10 is elevated; until the top surface of the limiting buckle 101 of the upper casing 10 abuts the flange 201 of the inner casing 20, the upper casing 10 is elevated continuously, however, the threads have already been completely unscrewed. At this time, a side surface of the limiting buckle 101 abuts a sidewall of the limiting groove 208, the rotation of the upper casing 10 relative to the inner casing 20 is limited, and the positioning rib 202 just slides into the positioning groove 106, so that the pressing wall 104 separates from the connecting wall 204, and the gasket 70 in a compressed state recovers at the same time. By the interaction between the pin 90 and the pin holes 206, 402, the inner casing 20 is opened relative to the tray 40, and thus the whole powder box is opened.

After use, the powder puff 50 is placed into the tray 40, the sub-assembly including the upper casing 10 and the inner casing 20 is closed, and the upper casing 10 is thus rotated; by the interaction between the first two-headed thread 102 and the second two-headed thread 601, the upper casing 10 moves downwards, and the positioning rib 202 slides out of the positioning groove 106; at this time, the side surface of the limiting buckle 101 abuts the sidewall of the limiting groove 208, thereby limits the rotation of the upper casing 10 relative to the inner casing 20. When the tray 40 makes the gasket 70 to press the gasket fastening surface 602 of the storage box 60, a bottom end of the pressing wall 104 is pressed against the top surface of the connecting wall 204; at this time, under the actions of the gasket pressing surface 405 and the gasket fastening surface 602, the gasket 70 is in a compressed state; thus, the powder box is closed and the tray 40 is completely sealed.

In the sealable powder box provided by the present application, the upper casing 10 and the inner casing 20 can axially slide and radially rotate relative to each other in predetermined ranges, the upper casing 10 is connected with the storage box 60 by threads, and the gasket 70 is arranged between the tray 40 and the storage box 60. Therefore, perfect seal between a lid and a powder box body can be easily realized under the condition of ensuring that the powder box is opened and closed by simple methods.

What described above are only preferred embodiments of the present application, and are not intended to limit the scope of the present application; and any modifications, equivalent replacements, and improvements made within the spirit and principle of the present application should be included in the protection scope of the present application.

What is claimed is:

1. A sealable powder box comprising an upper casing, a lower casing, an inner casing mounted in the upper casing, a storage box mounted in the lower casing and defining a containing space for receiving powder, a tray arranged in the storage box and covering an opening of the containing space, a powder puff disposed at the tray on a side opposite to the containing space; wherein, the sealable powder box further comprises a gasket, the gasket is arranged in the tray by means of injection molding, or is sandwiched between the tray and the storage box and engaged with the tray; the inner casing is mounted in the upper casing, and a top part of the inner casing penetrates a top part of the upper casing to be exposed; the upper casing and the inner casing are axially slidable and radially rotatable relative to each other in predetermined ranges, the storage box is engaged in the lower casing and threadingly connected with the upper casing, and the inner casing and the tray are connected with the lower casing by a pin, and wherein the inner casing and the tray are both rotatable relative to the lower casing about the pin.

2. The sealable powder box according to claim 1, wherein the tray forms a gasket clasp downwards at its bottom wall, and a portion of the bottom wall of the tray located at an outside of the gasket clasp is provided with a gasket pressing surface; an inside of the storage box is provided with a step-shaped gasket fastening surface, a bottom of the gasket clasp is engaged with an bottom of the gasket, so that the gasket is engaged with the tray; an upper edge of gasket abuts the gasket pressing surface, and a lower edge of the gasket abuts the gasket fastening surface.

3. The sealable powder box according to claim 1, wherein the upper casing includes a first top wall and a double-layered first sidewall extending from the first top wall and forming a loop, the first top wall is provided with a through hole and is inwardly provided around the through hole with an annular pressing wall being coaxial with the through hole; the inner casing includes an annular and double-layered second sidewall, a second top wall connected with a top edge of an inner layer of the second sidewall, and a connecting wall connected with both bottom edges of inner and outer layers of the second sidewall; a top surface of the connecting wall is matched with a bottom end of the pressing wall to limit upward sliding of the inner casing relative to the upper casing.

4. The sealable powder box according to claim 3, wherein a bottom surface of the connecting wall extends vertically and downwards to form a lens mounting loop, and the sealable powder box further comprises a lens forming an interference fit with the lens mounting loop and thereby mounted in the inner casing.

5. The sealable powder box according to claim 4, wherein a part of the bottom surface of the connecting wall located at an outside of the lens mounting loop is provided with a lower pressing surface; when the sealable powder box is closed, the lower pressing surface is matched with and pressed against a top edge of the tray and a top edge of the storage box.

6. The sealable powder box according to claim 3, wherein an inside of the pressing wall is inwardly and spacedly provided with a limiting buckle and a positioning groove; an outer edge of the top wall of the inner casing extends radially and outwards to form a flange, a bottom surface of the flange is matched with a top surface of the limiting buckle to prevent the upper casing from separating from the inner casing and limit upward sliding of the upper casing relative to the inner casing; an inner layer of the second sidewall of the inner casing is provided with a positioning rib protruding outwards and a limiting groove recessing inwards, the positioning rib is forced into the positioning groove at the inside of the pressing wall correspondingly, so that the upper casing is radially held relative to the inner casing; the limiting groove is matched with the limiting buckle to limit a distance of a rotation of the upper casing relative to the inner casing.

7. The sealable powder box according to claim 3, wherein an inmost upper part of the double-layered first sidewall of the upper casing is provided with a rotation matching surface; an outer layer of the second sidewall of the inner casing is provided with a rotation matching rib protruding outwards, and the rotation matching rib is matched with the rotation matching surface of the upper casing to facilitate a rotation of the upper casing relative to the inner casing.

8. The sealable powder box according to claim 7, wherein the upper casing is provided with a first two-headed thread at a lower part of the rotation matching surface, the storage box is provided with a second two-headed thread at an upper part of an outside thereof, and the upper casing is rotatably connected with the storage box by the first and second two-headed threads.

9. The sealable powder box according to claim 3, wherein the outer layer of the second sidewall of the inner casing forms a downward cantilever with a pin hole, a sidewall of the tray is provided with an outward cantilever with a pin hole, and an upper part of the storage box is provided with a gap configured to allow the cantilever of the inner casing and the cantilever of the tray to pass through; the lower casing includes a bottom wall and a plurality of sidewalls, one of the sidewalls is provided with a gap configured to mount the cantilever of the inner casing and the cantilever of the tray, the sidewall is further provided with pin holes arranged at parts thereof located at two sides of the gap of the sidewall, and a pin is inserted in the pin holes of the inner casing, the tray, and the lower casing.

10. The sealable powder box according to claim 9, wherein a lower part of an outside of the storage box is provided with at least one buckle, another sidewall of the lower casing that is opposite to the sidewall of the lower casing being provided with the gap is provided with at least one buckling groove, the buckling groove is matched with the buckle of the storage box to engage the storage box with the lower casing.

11. A sealable powder box comprising an upper casing, a lower casing, an inner casing mounted in the upper casing, a storage box mounted in the lower casing, and a tray arranged in the storage box; wherein, the sealable powder box further comprises a gasket, the gasket is arranged in the tray by means of injection molding, or is sandwiched between the tray and the storage box and engaged with the tray; the inner casing is mounted in the upper casing, and a top part of the inner casing penetrates a top part of the upper casing to be exposed; the upper casing and the inner casing are axially slidable and radially rotatable relative to each other in predetermined ranges, the storage box is engaged in the lower casing and threadingly connected with the upper casing, and the inner casing and the tray are rotatably connected with the lower casing by a pin, and wherein the tray forms a gasket clasp downwards at its bottom wall, and a portion of the bottom wall of the tray located at an outside of the gasket clasp is provided with a gasket pressing surface; an inside of the storage box is provided with a step-shaped gasket fastening surface, a bottom of the gasket clasp is engaged with an bottom of the gasket, so that the gasket is engaged with the tray; an upper edge of gasket abuts the gasket pressing surface, and a lower edge of the gasket abuts the gasket fastening surface.

12. A sealable powder box comprising an upper casing, a lower casing, an inner casing mounted in the upper casing, a storage box mounted in the lower casing, and a tray arranged in the storage box; wherein, the sealable powder box further comprises a gasket, the gasket is arranged in the tray by means of injection molding, or is sandwiched between the tray and the storage box and engaged with the tray; the inner casing is mounted in the upper casing, and a top part of the inner casing penetrates a top part of the upper casing to be exposed; the upper casing and the inner casing are axially slidable and radially rotatable relative to each other in predetermined ranges, the storage box is engaged in the lower casing and threadingly connected with the upper casing, and the inner casing and the tray are rotatably connected with the lower casing by a pin, and wherein the upper casing includes a first top wall and a double-layered first sidewall extending from the first top wall and forming a loop, the first top wall is provided with a through hole and is inwardly provided around the through hole with an annular pressing wall being coaxial with the through hole; the inner casing includes an annular and double-layered second sidewall, a second top wall connected with a top edge of an inner layer of the second sidewall, and a connecting wall connected with both bottom edges of inner and outer layers of the second sidewall; a top surface of the connecting wall is matched with a bottom end of the pressing wall to limit upward sliding of the inner casing relative to the upper casing.

* * * * *